US006159920A

United States Patent [19]

Ridyard

[11] Patent Number: 6,159,920

[45] Date of Patent: Dec. 12, 2000

[54] SPRAYED GRANULE

[75] Inventor: Mark William Ridyard, Newcatle upon Tyne, United Kingdom

[73] Assignee: The Proctor & Gamble Company, Cincinnati, Ohio

[21] Appl. No.: 09/423,504

[22] PCT Filed: May 1, 1998

[86] PCT No.: PCT/IB98/00664

§ 371 Date: Nov. 9, 1999

§ 102(e) Date: Nov. 9, 1999

[87] PCT Pub. No.: WO98/51765

PCT Pub. Date: Nov. 19, 1998

[30] Foreign Application Priority Data

May 9, 1997 [BE] Belgium ..... 97303180

[51] Int. Cl.[7] ..... C11D 1/72; C11D 3/42

[52] U.S. Cl. ..... 510/324; 510/326; 510/349; 510/356; 510/394; 510/446; 510/452; 510/456

[58] Field of Search ..... 510/324, 326, 510/349, 356, 446, 452, 456, 394

[56] References Cited

U.S. PATENT DOCUMENTS

| | | | |
|---|---|---|---|
| 4,869,843 | 9/1989 | Saito et al. | 252/135 |
| 5,000,869 | 3/1991 | Dittert | 252/174.13 |
| 5,560,748 | 10/1996 | Suruzidis et al. | 8/111 |
| 5,958,858 | 9/1999 | Bettiol et al. | 510/351 |
| 5,998,351 | 12/1999 | Brouwer et al. | 510/324 |

*Primary Examiner*—Gregory R. DelCotto
*Attorney, Agent, or Firm*—Marianne Dressman; Kim William Zerby; Steven W. Miller

[57] ABSTRACT

A detergent composition comprises detergent particles, each particle having a substantially anhydrous coating comprising a fluorescent whitening agent and a nonionic surfactant. A process for the preparation of the said detergent composition comprises spraying base detergent particles with a substantially anhydrous mixture comprising the fluorescent whitening agent and the nonionic surfactant.

14 Claims, No Drawings

SPRAYED GRANULE

FIELD OF THE INVENTION

The present invention relates to a novel detergent composition and a process for preparing the same, and in particular to the provision of a laundry composition having improved whiteness as perceived by the consumer.

BACKGROUND OF THE INVENTION

The use of whitening agents, or brighteners, in laundry applications to whiten fabrics has been widespread since the mid-1970s. Since then, much research has been carried out into the properties of such whitening agents, and many different compositions including such agents have been described in the literature. However, most applications of whitening agents have been for the purpose of fabric whitening, rather than whitening of the detergent composition itself.

WO 94/05761 discloses a process for preparing a high density granular detergent composition in which the bulk density of the detergent composition is increased by spraying detergent particles with a liquid and then dusting with a fine powder in a rotating drum or mixer. It is preferred that the liquid comprise a nonionic surfactant. Optionally, the liquid may also include other ingredients, such as perfume or a slurry, in water, of an optical brightener. The Examples describe the use of a 20% aqueous solution of optical brightener.

However, a problem with mixing a nonionic surfactant with water is that this can lead to the formation of flakes of nonionic surfactant which tend to block the spray nozzle, thereby interrupting the process and requiring cleaning of the nozzle before the process can re-start. Furthermore, the use of an aqueous spray tends to be detrimental to the stability of the final detergent composition because water tends to react with and/or promote reaction of components of the composition.

JP-A-07286198 discloses a process for preparing a granular nonionic detergent composition comprising spray-drying detergent particles containing 1% by weight of a nonionic surfactant and 0.01% by weight of a brightener. The brightener is first dissolved and/or dispersed in the nonionic surfactant, and is then granulated with other ingredients to form detergent particles prior to spray-drying. The process is designed to prevent unevenness of fluorescence of textile articles during washing.

SUMMARY OF THE INVENTION

According to a first aspect of the present invention, a detergent composition comprises detergent particles, each particle having a substantially anhydrous coating comprising a fluorescent whitening agent and a nonionic surfactant.

The composition of the present invention has improved whiteness properties, even with very low levels of whitening agent, as compared to a composition in which the whitening agent is present throughout the detergent particles, as disclosed in JP-A-0728198, discussed above.

According to a second aspect of the present invention, a process for preparing a detergent composition comprises spraying detergent particles with a substantially anhydrous mixture comprising a fluorescent whitening agent and a nonionic surfactant.

As the process of the present invention substantially excludes the presence of water during spraying of the whitening agent/nonionic surfactant mixture, it overcomes two major problems experienced in the prior art when spraying nonionic surfactant when wet. In addition, a dramatic increase in the whiteness of the resulting product is observed.

According to a third aspect of the present invention, the use of a substantially anhydrous mixture comprising a fluorescent whitening agent and a nonionic surfactant improves the whiteness properties of detergent particles, when the detergent particles are sprayed with the said mixture.

DESCRIPTION OF THE INVENTION

Prior to spraying the detergent particles, a substantially anhydrous mixture of whitening agent and nonionic surfactant is prepared by dispersing or partially dissolving the whitening agent in the nonionic surfactant, preferably with mixing to achieve a substantially homogenous mixture. The homogeneity of the mixture may be assessed using, for example, a UV lamp, thereby determining uniformity of fluorescence. The temperature at which the whitening agent and the nonionic surfactant are mixed is selected so as not to damage either of those components. Typically, however, the temperature will be in the range 25–80° C., and preferably 30–60° C.

In the context of the present Application, by substantially anhydrous we mean that the amount of water present in the mixture of whitening agent and nonionic surfactant-is less than 5% by weight of that mixture, preferably less than 3% by weight, and more preferably less than 1% by weight. Most preferably, the mixture should contain no added water above that included in the commercially available forms of the whitening agent and the nonionic surfactant. For instance, some nonionic surfactants may include around 0.5% by weight water.

The ratio of whitening agent: nonionic surfactant included in the mixture to be sprayed onto the detergent particles will depend, in part, on the nature of the whitening agent and the nonionic surfactant, and also in the nature of the final product into which the coated particles are to be incorporated. Generally, however, the ratio of whitening agent: nonionic surfactant will be in the range 1:500 to 1:5, and typically 1:400 to 1:10, by weight. It may be preferred to use a ratio of whitening agent: nonionic surfactant of 1:75 to 1:200 by weight for compact products, a ratio of 1:150 to 1:400 by weight for "big-box" products, and a ratio of 1:5 to 1:50 by weight for individual detergent additives, eg. in agglomerate, capsule or exudate form.

The whitening agent is preferably a biphenyl distyryl compound, such as disodium 4,4'-bis(2-sulphostyryl) biphenyl, otherwise known as Brightener 49 or Tinopal CBS (trade name, supplied by Ciba Geigy), or a coumarin compound, such as Tinopal SWN (trade name, suppled by Ciba Geigy). However, other whitening agents known in the art may also be suitable for use in the present invention, including benzidene sulfone disulfonic acids (BS), naphthotriazoylstilbene sulfonic acids (NTSA), amino coumarins (AC) and diphenylpyrazolines (DP), and derivatives thereof.

Any suitable nonionic surfactant, or mixture of nonionic surfactants, may be used, provided that this is capable of forming a substantially homogenous dispersion, or solution, with the whitening agent. For instance, suitable nonionic surfactants include water-soluble condensation products of aliphatic alcohols having from 8 to 22 carbon atoms, in either straight or branched configuration, and which are optionally ethoxylated, for instance with 3 to 100 mols of ethylene oxide per mol of alcohol. Preferred are the condensation products of alcohols having 9 to 15 carbon atoms, with 3 to 80 mols of ethylene oxide per mol of alcohol.

Typically, the amount of the whitening agent/nonionic surfactant mixture sprayed onto the detergent particles will constitute 0.1 to 10%, preferably 0.2 to 5%, by weight of the total particle weight. This means that the amount of whitening agent present can be as low as 0.01% by weight, and yet still provide beneficial results with regard to the whiteness of the composition.

The base detergent particles themselves, i.e. the particles onto which the whitening agent/nonionic surfactant mixture is sprayed, may comprise any suitable detergent components. For instance, the detergent particles may comprise surfactants selected from anionic, zwitterionic, ampholytic and cationic surfactants, and mixtures thereof The detergent particles may also comprise a nonionic surfactant, which may be the same or different to the nonionic surfactant used to coat those particles. Suitable examples of such surfactants include any of those disclosed in WO-A-9405761.

The base detergent particles may also include a whitening agent, which may be the same or different to the whitening agent used to coat the particles. Any conventional whitening agent is suitable for this purpose.

The base detergent particles may also include a builder, which may be selected from conventional builders for use in laundry detergents. Suitable examples include aluminosilicate ion exchange materials, neutral or alkaline salts, inorganic phosphate builders, nonphosphorous organic builders and polymeric builders, and any of the builders disclosed in WO-A-9405761.

Other ingredients commonly used in detergent compositions can also be included in the compositions of the present invention. Examples of such ingredients are disclosed in WO-A-9405761.

The base detergent particles may be prepared by any of the known methods. For instance, in one method each component is metered by weight onto a moving belt, and then blended together in a rotating drum or mixer to agglomerate the separate components. In another method, a number of high active pastes, typically at least 40% by weight active, are agglomerated, for instance as described in any of EP-A-0508543, EP-A-0578872, EP-A-0618289 and EP-A-0663439. In yet another method, the detergent particles may be prepared by forming a slurry of the individual components, and then spray-drying the slurry to produce a "blown powder". The method of preparation used will generally depend upon final form of product required, and the final product may contain particles prepared by a number of different methods.

The whitening agent/nonionic surfactant mixture may be sprayed onto the base detergent particles by any conventional spraying means. For instance, a Loedige CB mixer may be used. The rate at which the mixture is sprayed onto the detergent particles will vary according to the method of spraying, but will typically be in the range 0.5 to 5 tonnes/hr for a commercial process.

After the detergent particles have been sprayed with the whitening agent/nonionic surfactant mixture they may be slightly sticky in nature. In this case, it may be preferred to dust the detergent particles with a processing aid, typically in the form of a fine powder having a particle size of up to 100 $\mu$m, but generally up to 10 $\mu$m, such as a zeolite, silica, clay, carbonate or starch, or any other suitable material.

The final, coated, detergent particles may be used as a detergent composition by themselves, for instance if each particle comprises a mixture of detergent components of if the composition comprises different particles comprising different detergent components. Alternatively, or additionally, the coated detergent particles may be mixed with other particulate detergent materials, as are conventionally used in the laundry field. The present invention is further illustrated by the following Examples, in which, where not otherwise stated, all amounts are given in % by weight of the total composition, and the abbreviations used have the following meanings:

| | |
|---|---|
| LAS | Sodium linear $C_{11-13}$ alkyl benzene sulfonate |
| TAS | Sodium tallow alkyl sulfate |
| CxyAS | Sodium $C_{1x}$–$C_{1y}$ alkyl sulfate |
| C46SAS | Sodium $C_{14}$–$C_{16}$ secondary (2,3) alkyl sulfate |
| CxyEzS | Sodium $C_{1x}$–$C_{1y}$ alkyl sulfate condensed with z moles of ethylene oxide |
| CxyEz | $C_{1x}$–$C_{1y}$ predominantly linear primary alcohol condensed with an average of z moles of ethylene oxide |
| QAS | $R_2.N^+(CH_3)_2(C_2H_4OH)$ with $R_2 = C_8$–$C_{14}$ |
| Soap | Sodium linear alkyl carboxylate derived from 80/20 mixture of tallow and coconut fatty acids |
| CFAA | $C_{12}$–$C_{14}$ (coco) alkyl N-methyl glucamide |
| TFAA | $C_{16}$–$C_{18}$ alkyl N-methyl glucamide |
| TPKFA | $C_{12}$–$C_{14}$ topped whole cut fatty acids |
| STPP | Anhydrous sodium tripolyphosphate |
| TSPP | Tetrasodium pyrophosphate |
| Zeolite A | Hydrated sodium aluminosilicate of formula $Na_{12}(Al0_2SiO_2)_{12}.27H_2O$ having a primary particle size in the range from 0.1 to 10 $\mu$m (weight expressed on an anhydrous basis) |
| NaSKS-6 | Crystalline layered silicate of formula - $Na_2Si_2O_5$ |
| Citric acid | Anhydrous citric acid |
| Borate | Sodium borate |
| Carbonate | Anhydrous sodium carbonate with a particle size between 200 $\mu$m and 900 $\mu$m |
| Bicarbonate | Anhydrous sodium bicarbonate with a particle size distribution between 400 $\mu$m and 1200 $\mu$m |
| Silicate | Amorphous sodium silicate ($SiO_2$:$Na_2O$ = 2.0:1) |
| Sulfate | Anhydrous sodium sulfate |
| Citrate | Tri-sodium citrate dihydrate of activity 86.4% with a particle size distribution between 425 $\mu$m and 850 $\mu$m |
| MA/AA | Copolymer of 1:4 maleic/acrylic acid, average molecular weight about 70,000 |
| AA | Sodium polyacrylate polymer of average molecular weight 4,500 |
| CMC | Sodium carboxymethyl cellulose |
| Cellulose ether | Methyl cellulose ether with a degree of polymerization of 650 available from Shin Etsu Chemicals |
| Protease | Proteolytic enzyme of activity 4KNPU/g sold by NOVO Industries A/S under the tradename Savinase |
| Alcalase | Proteolytic enzyme of activity 3AU/g sold by NOVO Industries A/S |
| Cellulase | Cellulytic enzyme of activity 1000 CEVU/g sold by NOVO Industries A/S under the tradename Carezyme |
| Amylase | Amylolytic enzyme of activity 120KNU/g sold by NOVO Industries A/S under the tradename Termamyl 120T |
| Lipase | Lipolytic enzyme of activity 100KLU/g sold by NOVO Industries A/S under the tradename Lipolase |
| Endolase | Endoglucanase enzyme of activity 3000 CEVU/g sold by NOVO Industries A/S |
| PB4 | Sodium perborate tetrahydrate of nominal formula $NaBO_2.3H_2O.H_2O_2$ |
| PB1 | Anhydrous sodium perborate bleach of nominal formula $NaBO_2.H_2O_2$ |
| Percarbonate | Sodium percarbonate of nominal formula $2Na_2CO_3.3H_2O_2$ |
| NOBS | Nonanoyloxybenzene sulfonate in the form of the sodium salt |
| NAC-OBS | (6-nonamidocaproyl)oxybenzene sulfonate |
| TAED | Tetraacetylethylenediamine |
| DTPA | Diethylene triamine pentaacetic acid |
| DTPMP | Diethylene triamine penta(methylene phosphonate), marketed by Monsanto under the Tradename Dequest 2060 |
| EDDS | Ethylenediamine-N,N'-disuccinic acid, (S,S)-isomer in the form of its sodium salt. |
| Photoacti- | Sulfonated zinc phthlocyanine encapsulated in |

-continued

| | |
|---|---|
| vated bleach | dextrin soluble polymer |
| Brightener 1 | Disodium 4,4'-bis(2-sulphostyryl)biphenyl |
| Brightener 2 | Disodium 4,4'-bis(4-anilino-6-morpholino-1,3,5-triazin-2-yl)amino stilbene-2,2'-disulfonate |
| HEDP | 1,1-hydroxyethane diphosphonic acid |
| PEGx | Polyethylene glycol, with a molecular weight of x |
| PEO | Polyethylene oxide, with an average molecular weight of 50,000 |
| TEPAF | Tetraethylenepentaamine ethoxylate |
| PVP | Polyvinylpyrolidone polymer, with an average molecular weight of 60,000 |
| PVNO | Polyvinylpyridine N-oxide polymer, with an average molecular weight of 50,000 |
| PVPVI | Copolymer of polyvinyipyrolidone and vinylimidazole, with an average molecular weight of 20,000 |
| QEA | bis[$(C_2H_5O)(C_2H_4O)_n$]$CH_3$—$N^+$—$C_6H_{12}$—$N^+(CH_3)$bis[$(C_2H_5O)$—$(C_2H_4O)_m$) where n = from 20–30. |
| SRP 1 | Sulfobenzoyl and capped esters with oxyethylene oxy and terephtaloyl backbone |
| SRP 2 | Diethoxylated poly (1, 2- propylene terephtalate) short block polymer |
| Silicone antifoam | Polydimethylsiloxane foam controller with siloxane-oxyalkylene copolymer as dispersing agent with a ratio of said foam controller to said dispersing agent of 10:1 to 100:1 |
| Wax | Paraffin wax |
| Levante | Perfume |

EXAMPLES

Example 1

A slurry was prepared by mixing together anionic surfactant paste(s), inorganic materials and detergent minors to a final moisture content of 20–35% by weight. This slurry was then spray-dried using a spray-drying tower to produce a "blown powder".

To a mixing vessel of 3 $m^3$, stirred with a paddle stirrer and having a recirculation line, was added the nonionic surfactant(s). To this nonionic surfactant was added powdered brightener at a rate of 5 kg/minute to ensure an even dispersion of the brightener in the nonionic. This mixture was left stirring for 30 minutes at a temperature of 35–60° C., depending on the nonionic used, to ensure complete dispersion of the brightener. At the end of this period a small sample of the solution/dispersion obtained was taken and assessed under a UV lamp for uniform fluorescence, and hence even distribution of the brightener.

The nonionic/brighter dispersion was then pumped to a Loedige CB 30 mixer. It entered the Loedige mixer at a rate of 2 tonnes/hr through an aperture of 5 mm. At the same end of the Loedige mixer a stream of the spray-dried powder was intimately mixed with the nonionic/brightener stream. The resulting mixture exited through the opposite end of the Loedige mixer.

Any other additives to be sprayed on, eg. perfume, were sprayed separately.

The finished, coated, powder was then mixed with other dry detergent additives.

The formulations in Tables 1 to 3 were prepared in this manner.

TABLE 1

| | A | B | C | D |
|---|---|---|---|---|
| Blown powder | | | | |
| LAS | 6.0 | 5.0 | 11.0 | 6.0 |
| TAS | 2.0 | — | — | 2.0 |
| Zeolite A | — | 27.0 | — | 20.0 |
| STPP | 24.0 | — | 24.0 | — |
| Sulfate | 9.0 | 6.0 | 13.0 | — |
| MA/AA | 2.0 | 4.0 | 6.0 | 4.0 |
| Silicate | 7.0 | 3.0 | 3.0 | 3.0 |
| CMC | 1.0 | 1.0 | 0.5 | 0.6 |
| Brightener 1 | — | — | 0.1 | 0.2 |
| Silicone antifoam | 1.0 | 1.0 | 1.0 | 0.3 |
| DTPMP | 0.4 | 0.4 | 0.2 | 0.4 |
| Spray on | | | | |
| C45E7 | — | — | — | 5.0 |
| C45E2 | 2.5 | 2.5 | 2.0 | — |
| C45E3 | 2.6 | 2.5 | 2.0 | — |
| Brightener 1 | 0.05 | 0.015 | 0.1 | 0.1 |
| Perfume | 0.3 | 0.3 | 0.3 | 0.2 |
| Silicone antifoam | 0.3 | 0.3 | 0.3 | — |
| Dry additives | | | | |
| Sulfate | 3.0 | 3.0 | 5.0 | 10.0 |
| Carbonate | 6.0 | 13.0 | 15.0 | 14.0 |
| Citric acid | 1.0 | — | — | 1.0 |
| PB1 | — | — | — | 1.5 |
| PB4 | 18.0 | 18.0 | 10.0 | 18.5 |
| TAED | 3.0 | 2.0 | — | 2.0 |
| NAC-OBS | — | 2.0 | 4.0 | — |
| Protease | 1.0 | 1.0 | 1.0 | 1.0 |
| Lipase | 0.4 | 0.4 | 0.4 | 0.2 |
| Amylase | 0.2 | 0.2 | 0.2 | 0.4 |
| QEA | — | — | — | 1.0 |
| Photoactivated bleach | — | — | — | 15 ppm |
| Misc/minor to 100% | | | | |

The above detergent formulations are of particular utility under European machine wash conditions.

TABLE 2

| | E | F | G |
|---|---|---|---|
| Blown Powder | | | |
| Zeolite A | 30.0 | 22.0 | 6.0 |
| Sulfate | 19.0 | 5.0 | 7.0 |
| MA/AA | 3.0 | 3.0 | 6.0 |
| LAS | 14.0 | 12.0 | 22.0 |
| C45AS | 8.0 | 7.0 | 7.0 |
| Silicate | — | 1.0 | 5.0 |
| Soap | — | — | 2.0 |
| Brightener 1 | 0.2 | 0.2 | 0.2 |
| Carbonate | 8.0 | 16.0 | 20.0 |
| DTPMP | — | 0.4 | 0.4 |
| Spray On | — | 1.0 | 5.0 |
| C45E7 | 1.0 | 1.0 | 1.0 |
| Brightener 1 | 0.15 | 0.25 | 0.1 |
| Dry additives | | | |
| QEA | — | — | 1.0 |
| PVPVI/PVNO | 0.5 | 0.5 | 0.5 |
| Protease | 1.0 | 1.0 | 1.0 |
| Lipase | 0.4 | 0.4 | 0.4 |
| Amylase | 0.1 | 0.1 | 0.1 |
| Cellulase | 0.1 | 0.1 | 0.1 |
| NOBS | — | 6.1 | — |
| NAC-OBS | — | — | 4.5 |
| PB1 | 1.0 | 5.0 | 6.0 |
| Sulfate | — | 6.0 | — |
| Misc/minors to 100% | | | |

Formulations E and F are of particular utility under US machine wash conditions. G is of particular utility under Japanese machine wash conditions.

TABLE 3

| | H | I |
|---|---|---|
| Blown powder | | |
| Zeolite A | 20.0 | — |
| STPP | — | 20.0 |
| LAS | 6.0 | 6.0 |
| C68AS | 2.0 | 2.0 |
| QAS | 1.0 | — |
| Silicate | 3.0 | 8.0 |
| MA/AA | 4.0 | 2.0 |
| CMC | 0.6 | 0.6 |
| Brightener 1 | 0.2 | 0.2 |
| DTPMP | 0.4 | 0.4 |
| Spray on | | |
| C45E7 | 5.0 | 5.0 |
| Brightener 1 | 0.05 | 0.05 |
| Silicone antifoam | 0.3 | 0.3 |
| Perfume | 0.2 | 0.2 |
| Dry additives | | |
| Carbonate | 14.0 | 9.0 |
| PB1 | 1.5 | 2.0 |
| PB4 | 18.5 | 13.0 |
| TAED | 2.0 | 2.0 |
| Photoactivated bleach | 15 ppm | 15 ppm |
| Protease | 1.0 | 1.0 |
| Lipase | 0.2 | 0.2 |
| Amylase | 0.4 | 0.4 |
| Cellulase | 0.1 | 0.1 |
| Sulfate | 10.0 | 20.0 |
| Misc/minors to 100% | | |
| Density (g/liter) | 700 | 700 |

The above granular detergent compositions are of particular utility under European wash conditions.

Example 2

A coated, blown powder was prepared as described in Example 1, and mixed with anionic surfactant agglomerates and other dry detergent additives.

The anionic surfactant agglomerates were produced as described in Example 1 of EP-A-0663439, by forming high active, eg. approx. 80% active, anionic pastes and mixing these in a twin-screw extruder with silicate and polymer, if present. The mixture was then passed to a Loedige CB mixer where it was mixed with a powder stream of zeolite and carbonate, if present. The irregular shaped particles formed were allowed to fall under gravity into a Loedige KM mixer, where they were rounded and dusted with zeolite. The particles were then passed to a fluid bed drier, to remove excess water present.

The formulations in Table 4 were prepared in this manner. Formulation J is particularly suitable for usage under Japanese machine wash conditions. Formulations K to O are particularly suitable for use under US machine wash conditions.

TABLE 4

| | J | K | L | M | N | O |
|---|---|---|---|---|---|---|
| Blown powder | | | | | | |
| LAS | 22.0 | 5.0 | 4.0 | 9.0 | 8.0 | 7.0 |
| C45AS | 7.0 | 7.0 | 6.0 | — | — | — |

TABLE 4-continued

| | J | K | L | M | N | O |
|---|---|---|---|---|---|---|
| C46SAS | — | 4.0 | 3.0 | — | — | — |
| C45E35 | — | 3.0 | 2.0 | 8.0 | 5.0 | 4.0 |
| QAS | — | — | 1.0 | — | — | — |
| Zeolite A | 6.0 | 16.0 | 14.0 | 19.0 | 16.0 | 14.0 |
| MA/AA | 6.0 | 3.0 | 3.0 | — | — | — |
| AA | — | 3.0 | 3.0 | 2.0 | 3.0 | 3.0 |
| Sulfate | 7.0 | 18.3 | 11.3 | 24.0 | 19.3 | 19.3 |
| Silicate | 5.0 | 1.0 | 1.0 | 2.0 | 1.0 | 1.0 |
| Carbonate | 28.3 | 9.0 | 7.0 | 25.7 | 8.0 | 6.0 |
| PEG 4000 | 0.5 | 1.5 | 1.5 | 1.0 | 1.5 | 1.0 |
| Sodium oleate | 2.0 | — | — | — | — | — |
| DTPA | 0.4 | — | 0.5 | — | — | 0.5 |
| Brightener 2 | 0.2 | 0.3 | 0.3 | 0.3 | 0.3 | 0.3 |
| Spray on | | | | | | |
| C25E9 | 1.0 | — | — | — | — | — |
| C45E7 | — | 2.0 | 2.0 | 0.5 | 2.0 | 2.0 |
| Brightener 1 | 0.1 | 0.025 | 0.15 | 0.5 | 0.05 | 0.05 |
| Perfume | 1.0 | 0.3 | 0.3 | 1.0 | 0.3 | 0.3 |
| Agglomerate | | | | | | |
| C45AS | — | 5.0 | 5.0 | — | 5.0 | 5.0 |
| LAS | — | 2.0 | 2.0 | — | 2.0 | 2.0 |
| Zeolite A | — | 7.5 | 7.5 | — | 7.5 | 7.5 |
| Carbonate | — | 4.0 | 4.0 | — | 4.0 | 4.0 |
| PEG 4000 | — | 0.5 | 0.5 | — | 0.5 | 0.5 |
| Misc (water etc) | — | 2.0 | 2.0 | — | 2.0 | 2.0 |
| Dry additives | | | | | | |
| PB4 | — | 1.0 | 4.0 | — | 5.0 | 0.5 |
| PB1 | 6.0 | — | — | — | — | — |
| Percarbonate | — | 5.0 | 12.5 | — | — | — |
| Carbonate | — | 5.3 | 1.8 | — | 4.0 | 4.0 |
| NOBS | 4.5 | — | 6.0 | — | — | 0.6 |
| Cumeme sulfonic acid | — | 2.0 | 2.0 | — | 2.0 | 2.0 |
| Citric acid | — | — | 1.0 | — | — | 1.0 |
| Lipase | 0.4 | 0.4 | 0.4 | — | 0.4 | 0.4 |
| Cellulase | 0.1 | 0.2 | 0.2 | — | 0.2 | 0.2 |
| Amylase | 0.1 | 0.3 | 0.3 | — | — | — |
| Protease | 1.0 | 0.5 | 0.5 | 0.5 | 0.5 | 0.5 |
| PVPVI | — | 0.5 | 0.5 | — | — | — |
| PVP | 0.5 | 0.5 | 0.5 | — | — | — |
| PVNO | — | 0.5 | 0.5 | — | — | — |
| SRP1 | — | 0.5 | 0.5 | — | — | — |
| Silicone antifoam | — | 0.2 | 0.2 | — | 0.2 | 0.2 |
| Misc/minors to 100% | | | | | | |

Example 3

A nonionic surfactant(s)/brightener mixture was prepared as described in Example 1.

Anionic surfactant agglomerates, prepared as described in Example 2, and yellow in colour, were then added as a continuous free stream to a horizontal drum mixer, at a rate of 3 tonnes/hr. The nonionic/brightener mixture was sprayed through a two fluid nozzle onto the agglomerate near the entrance to the mixer at a rate of 30 kg/hr. Zeolite was then blown onto the agglomerates through a pipe near the exit of the mixer.

The resulting coated agglomerates were white and were mixed with a blown powder, produced according to Example 1, and other dry detergent additives.

The formulations shown in Tables 5 and 6 were prepared in this manner. The nil bleach-containing detergent formulations of Table 6 are of particular use in the washing of coloured clothing.

TABLE 5

| | P | Q | R |
|---|---|---|---|
| Blown Powder | | | |
| Zeolite A | 15.0 | 15.0 | — |
| Sulfate | 0.0 | 5.0 | — |
| LAS | 3.0 | 3.0 | — |
| DTPMP | 0.4 | 0.5 | — |
| CMC | 0.4 | 0.4 | — |
| MA/AA | 4.0 | 4.0 | — |
| Agglomerates | | | |
| C45AS | — | — | 11.0 |
| LAS | 6.0 | 5.0 | — |
| TAS | 3.0 | 2.0 | — |
| Silicate | 4.0 | 4.0 | — |
| Zeolite A | 10.0 | 15.0 | 13.0 |
| CMC | — | — | 0.5 |
| MA/AA | — | — | 2.0 |
| Carbonate | 9.0 | 7.0 | 7.0 |
| Spray On | | | |
| Perfume | 0.3 | 0.3 | 0.5 |
| C45E7 | 4.0 | 4.0 | 4.0 |
| C25E3 | 2.0 | 2.0 | 2.0 |
| Brightener 1 | 0.05 | 0.2 | 0.1 |
| Dry additives | | | |
| MA/AA | — | — | 3.0 |
| NaSKS-6 | — | — | 12.0 |
| Citrate | 10.0 | — | 8.0 |
| Bicarbonate | 7.0 | 3.0 | 5.0 |
| Carbonate | 8.0 | 5.0 | 7.0 |
| PVPVI/PVNO | 0.5 | 0.5 | 0.5 |
| Alcalase | 0.5 | 0.3 | 0.9 |
| Lipase | 0.4 | 0.4 | 0.4 |
| Amylase | 0.6 | 0.6 | 0.6 |
| Cellulase | 0.6 | 0.6 | 0.6 |
| Silicone antifoam | 5.0 | 5.0 | 5.0 |
| Sulfate | 0.0 | 9.0 | 0.0 |
| Misc/minors to 100% | 100.0 | 100.0 | 100.0 |
| Density (g/liter) | 700 | 700 | 700 |

TABLE 6

| | S | T | U |
|---|---|---|---|
| Blown Powder | | | |
| Zeolite A | 15.0 | 15.0 | 15.0 |
| Sulfate | 0.0 | 5.0 | 0.0 |
| LAS | 3.0 | 3.0 | 3.0 |
| QAS | — | 1.5 | 1.5 |
| DTPMP | 0.4 | 0.2 | 0.4 |
| EDDS | — | 0.4 | 0.2 |
| CMC | 0.4 | 0.4 | 0.4 |
| MA/AA | 4.0 | 2.0 | 2.0 |
| Agglomerates | | | |
| LAS | 5.0 | 5.0 | 5.0 |
| TAS | 2.0 | 2.0 | 1.0 |
| Silicate | 3.0 | 3.0 | 4.0 |
| Zeolite A | 8.0 | 8.0 | 8.0 |
| Carbonate | 8.0 | 8.0 | 4.0 |
| Spray On | | | |
| Perfume | 0.3 | 0.3 | 0.3 |
| C45E7 | 2.0 | 2.0 | 2.0 |
| C25E3 | 2.0 | — | — |
| Brightener 1 | 0.15 | 0.1 | 0.05 |
| Dry additives | | | |
| Citrate | 4.0 | — | 1.0 |
| Citric acid | 1.0 | — | 1.0 |
| Bicarbonate | — | 3.0 | — |
| Carbonate | 8.0 | 15.0 | 10.0 |

TABLE 6-continued

| | S | T | U |
|---|---|---|---|
| TAED | 6.0 | 2.0 | 5.0 |
| NAC-OBS | — | 4.0 | — |
| PB1 | 14.0 | 7.0 | 10.0 |
| QEA | — | — | 0.2 |
| Bentonite clay | — | — | 10.0 |
| Protease | 1.0 | 1.0 | 1.0 |
| Lipase | 0.4 | 0.4 | 0.4 |
| Amylase | 0.6 | 0.6 | 0.6 |
| Cellulase | 0.6 | 0.6 | 0.6 |
| Silicone antifoam | 5.0 | 5.0 | 5.0 |
| Dry additives | | | |
| Sodium sulfate | 0.0 | 3.0 | 0.0 |
| Misc/minors to 100% | 100.0 | 100.0 | 100.0 |
| Density (g/liter) | 850 | 850 | 850 |

Example 4

A nonionic surfactant/brightener mixture was prepared as described in Example 1, wherein the nonionic surfactant used was C25E3 and the ratio of brightener powder to nonionic surfactant was approx. 3:100, by weight.

A mixture of detergent materials was prepared by dosing the remaining dry additives detailed in Table 7 below, as supplied, on to a moving belt from loss-in-weight feeders. This mixture was then fed to an inclined rotating mix drum at a feed rate of 30 tonnes/hr. The nonionic/brightener mixture was sprayed through a two fluid nozzle onto the bed of particles at a rate of 1.5 tonnes/hr. The particles were then sprayed with perfume prior to exiting the drum. The resulting slightly sticky particles were then passed to a Loedige KM mixer where they were dusted with zeolite at 2 tonnes/hr.

TABLE 7

| | V | W | X | Y | Z | AA |
|---|---|---|---|---|---|---|
| LAS | — | 2.0 | 1.0 | 8.0 | 3.0 | 6.0 |
| C25E3 | 3.4 | 3.4 | 3.4 | 3.4 | 3.4 | 3.4 |
| C245AS | 8.0 | 5.0 | 6.5 | — | 3.0 | 4.0 |
| QAS | — | — | 0.8 | — | — | 0.8 |
| Zeolite A | 18.1 | 18.1 | 18.1 | 18.1 | 18.1 | 18.1 |
| Carbonate | 13.0 | 13.0 | 13.0 | 27.0 | 27.0 | 27.0 |
| Silicate | 1.4 | 1.4 | 1.4 | 3.0 | 3.0 | 3.0 |
| Sulfate | 6.0 | 6.0 | 6.0 | 6.0 | 6.0 | 6.0 |
| MA/AA | 0.3 | 0.3 | 0.3 | 0.3 | 0.3 | 0.3 |
| CMC | 0.2 | 0.2 | 0.2 | 0.2 | 0.2 | 0.2 |
| Percarbonate | 17.0 | 17.0 | 17.0 | 18.0 | 19.0 | 18.0 |
| TAED | 1.5 | 1.5 | 1.0 | 1.5 | — | 1.5 |
| NAC-OBS | — | — | 0.5 | 1.0 | 2.0 | — |
| DTPMP | 0.25 | 0.25 | | | 0.25 | 0.25 |
| EDDS | — | — | 0.25 | 0.4 | — | — |
| HEDP | 0.3 | 0.3 | 0.3 | 0.3 | 0.3 | 0.3 |
| Protease | 0.26 | 0.26 | 0.26 | 0.26 | 0.26 | 0.26 |
| Amylase | 0.1 | 0.1 | 0.1 | 0.1 | 0.1 | 0.1 |
| Photoactivated bleach (ppm) | 15 ppm | 15 ppm | 15 ppm | 15 ppm | 15 ppm | 15 ppm |
| Brightener 1 | 0.09 | 0.03 | 0.05 | 0.15 | 0.03 | 0.07 |
| Perfume | 0.3 | 0.3 | 0.3 | 0.3 | 0.3 | 0.3 |
| Silicone antifoam | 0.5 | 0.5 | 0.5 | 0.5 | 0.5 | 0.5 |
| Misc/minors to 100% | | | | | | |
| Density in g/liter | 850 | 850 | 850 | 850 | 850 | 850 |

The above high density granular laundry detergent compositions V to AA are of particular utility under European machine wash conditions.

Example 5

Three compact detergent powders, Powders I to III in Table 8 below, were prepared according to the method described in Example 1 of EP-A-0663439, except that when preparing Powder III a mixture of nonionic surfactant C45AE7 and Brightener 1 (produced according to Example 1 above) was sprayed onto the final compact powder.

Powder I is the Applicant's current Ariel Futur product, and is for reference only. Powder II, also for reference only, and Powder 111, according to the present invention, have the same composition as Powder I except that they contain no non-white components, in order to observe more readily the beneficial effects of the present invention.

TABLE 8

| | I | II | III |
|---|---|---|---|
| Surfactant | | | |
| LAS | 0.92 | 0.92 | 0.92 |
| TAS | 0.30 | 0.30 | 0.30 |
| C245AS | 6.97 | 6.97 | 6.97 |
| C25AE3S | 1.77 | 1.77 | 1.77 |
| C24AE5 | 4.83 | 4.70 | 4.70 |
| TFAA | 1.58 | | |
| Builder | | | |
| Zeolite | 15.93 | 15.93 | 15.93 |
| NaSKS-6 | 11.0 | 11.0 | 11.0 |
| Citric Acid | 3.00 | 3.00 | 3.00 |
| Buffer | | | |
| Carbonate | 8.51 | 8.51 | 8.51 |
| Sulphate | Balance | Balance | Balance |
| Silicate | 0.06 | 0.06 | 0.06 |
| Polymer | | | |
| MA/AA | 3.20 | 3.20 | 3.20 |
| CMC | 0.34 | 0.34 | 0.34 |
| SRP1 | 0.18 | 0.18 | 0.18 |
| Enzyme | | | |
| Protease | 0.36 | 0 | 0 |
| Cellulase | 0.26 | 0 | 0 |
| Amylase | 0.36 | 0 | 0 |
| Lipase | 0.15 | 0 | 0 |
| Bleach | | | |
| TAED | 4.80 | 4.80 | 4.80 |
| PC | 18.70 | 18.70 | 18.70 |
| HEDP | 0.48 | 0.48 | 0.48 |
| EDDS | 0.31 | 0.31 | 0.31 |
| Miscellaneous | | | |
| Brightener 1 | 0.04 | 0.04 | 0.04 |
| Brightener 2 | 0.19 | 0.12 | 0.12 |
| Photoactivated bleach | 0.0026 | 0.0026 | 0.0026 |
| Silcone antifoam | 0.33 | 0.33 | 0.33 |
| Levante | 0.45 | 0.45 | 0.45 |

The whiteness of each of Powders I to III was measured using a Hunterlab Colour/Difference meter Model D25-2 prior to dusting the powders with zeolite, and the measurements obtained applied using two different correlations for whiteness, defined as W1 and W2, as below.

W1=L−3b, by Hunter

W2=L+3a−3b, by Stensby.

The results are shown in Table 9, below.

TABLE 9

| | Hunter values | | | Whiteness | |
|---|---|---|---|---|---|
| | L | a | b | W1 | W2 |
| Powder I | 85.66 | 0.91 | 1.47 | 81.25 | 78.52 |
| Powder II | 91.17 | 1.39 | 2.53 | 83.58 | 87.75 |
| Powder III | 91.36 | 3.11 | −1.74 | 96.58 | 105.91 |

Comparison of the whiteness values W1 and W2 illustrates that Powder III, according to the present invention, has improved whiteness compared to Powder II, irrespective of the correlation used. Also, the b value measured for Powder III was considerably lower than that for Powder II, demonstrating that Powder III was much less yellow.

What is claimed is:

1. A detergent composition comprising detergent particles, each particle coated with a mixture consisting of a fluorescent whitening agent a nonionic surfactant , and less than 5% by weight water based on the weight of the whitening agent and nonionic surfactant, wherein the ratio of whitening agent to nonionic surfactant is in the range of 1:500 to 1:5, by weight.

2. A composition according to claim 1, wherein the whitening agent is a biphenyl distyryl compound or a coumarin compound.

3. A composition according to claim 1, wherein the whitening agent is disodium 4,4'-bis(2-sulphostyryl) biphenyl.

4. A composition according to claim 1, wherein the nonionic surfactant is a water-soluble condensation product of an aliphatic alcohol having 8 to 22 carbon atoms, optionally ethoxylated.

5. A composition according to claim 1, wherein the detergent particles contain a whitening agent, optionally of a different type to the whitening agent included in the coating.

6. A process for preparing a detergent composition comprising spraying detergent particles with a mixture to coat said particles consisting of a fluorescent whitening agent a nonionic surfactant, and less than 5% by weight water based on the weight of the whitening agent and nonionic surfactant, wherein the ratio of whitening agent to nonionic surfactant is in the range of 1:500 to 1:5, by weight.

7. A process according to claim 6, wherein the whitening agent is a biphenyl distyryl compound or a coumarin compound.

8. A process according to claim 6, wherein the nonionic surfactant is a water-soluble ethoxylated condensation product of an aliphatic alcohol having 8 to 22 carbon atoms.

9. A process according to claim 6, wherein prior to spraying the whitening agent is dispersed or dissolved in the nonionic surfactant.

10. A process according to claim 9, wherein dispersion or dissolution is carried out at a temperature in the range 25–80° C.

11. A process according to claim 6, wherein the detergent particles have been made by spray-drying.

12. A process according to any of claim 6, wherein the detergent particles have been made by agglomeration.

13. A process according to claim 6, which further comprises, after spraying the detergent particles, dusting the detergent particles with a powder.

14. A method for improving the whiteness properties of detergent particles. comprising spraying a mixture to coat said particles consisting of a fluorescent whitening agent a nonionic surfactant, and less than 5% by weight water based on the weight of the whitening agent and nonionic surfactant, wherein the ratio of whitening agent to nonionic surfactant is in the range of 1:500 to 1:5, by weight.

* * * * *